United States Patent [19]

Wilson

[11] Patent Number: 4,837,893

[45] Date of Patent: Jun. 13, 1989

[54] HAVING AN OVERFOLDED SPRING BIASED, ADJUSTABLY POSITIONED LEAF

[76] Inventor: Scott O. Wilson, 234 N. 75th St. #3, Milwaukee, Wis. 53213

[21] Appl. No.: 203,770

[22] Filed: Jun. 8, 1988

[51] Int. Cl.[4] ..... E05D 7/04

[52] U.S. Cl. ..... 16/240; 16/246

[58] Field of Search ..... 16/44, 240, 245, 246

[56] References Cited

U.S. PATENT DOCUMENTS

| | | | |
|---|---|---|---|
| 375,038 | 12/1887 | Wright | 16/246 |
| 776,321 | 11/1904 | Hartwig | 16/44 X |
| 794,454 | 7/1905 | Davis et al. | 16/240 |
| 880,317 | 2/1908 | Von De Marwitz | 16/246 |
| 1,314,732 | 9/1919 | Cochran et al. | 16/240 |
| 2,738,542 | 3/1956 | Clark, Jr. | 16/44 |
| 4,626,049 | 12/1986 | Gross et al. | 16/240 X |

*Primary Examiner*—Fred A. Silverberg

*Attorney, Agent, or Firm*—Leon Gilden

[57] ABSTRACT

An adjustable hinge is set forth wherein a hinge utilized for mounting doors and furniture and the like may be mounted for adjustment and alignment of adjacent surface of such furniture mounted for pivoting by the hinge. A first hinge plate is pivotally mounted to a second overfolded hinge plate providing aligned surfaces of said first and second hinge plate portions that are vertically adjustable relative to one another. A captured screw with a reduced shank is secured to a first portion of the overfolded hinge plate and threadedly mounted to an overlying second portion whereupon the second portion surface may be adjusted vertically relative to the first portion with a further included captured spring between the first and second portion to eliminate slack between the captured screw and the second portion.

1 Claim, 3 Drawing Sheets

HAVING AN OVERFOLDED SPRING BIASED, ADJUSTABLY POSITIONED LEAF

BACKGROUND OF THE INVENTION

1. Field of the Invention

The instant invention relates to hinge members and more particularly pertains to a new and improved hinge member that is adjustable to accommodate variances in adjacent mounted members.

2. Description of the Prior Art

The use of hinge members is well known in the prior art and particularly in the application of furniture and mounting arrangements. Adjustable hinge members have been utilized extensively through the prior art for alignment of adjacent pivoting surfaces. Shortcomings of such hinge members have been relative complexity and lack of accommodation of slack between interrelated threaded portions to effect adjustment. For example, U.S. Pat. No. 1,111,832 to Hazelrigg sets forth a first hinge portion pivotally mounted to a second hinge portion that may be adjustable in a vertical orientation, but is only adjustable for compression of an overfolded member and not for extension thereof and accordingly does not accommodate two-way adjustments of the overfolded portion, as opposed to the instant invention which sets forth a captured screw shank with a threaded portion of the shank to adjustably accommodate an overfolded portion for compression and extension thereof.

U.S. Pat. No. 2,373,955 to Fuller sets forth an adjustable hinge that is, as typical of prior art, does not provide for accommodation of slack between interrelated threaded portions and does not provide for vertical surface adjustment by use of a captured threaded screw shank.

U.S. Pat. No. 4,007,514 to Salice sets forth a hinge mounting device wherein a first member is laterally adjustably secured relative to the second member with a ramp on the first member to accommodate vertical adjustment of the first and second members together and accordingly, lacks the simplicity and effectiveness of the instant invention.

U.S. Pat. No. 4,312,098 to Sundermeier sets forth a plurality of surfaces in association with a hinge plate that may be adjusted by means of various set screws and the like and provides a first section of bracket overlying a second portion of a front surface of a vertical strip wherein the two mutually inclined sections of the bracket are utilized to reduce likelihood of separation of the hinge from an associated housing. The patent is of interest relative to a general adjustment organization, but is of a relatively remote structure to that of the instant invention.

U.S. Pat. No. 4,683,612 to Grass sets forth a furniture hinge provided with lateral and depth adjustment wherein a plurality of various bearings and cams are provided for effecting such adjustment, but the relative complexity of the organization sets forth an organization cumbersome and of a relatively remote organizational interrelationship relative to the instant invention.

As such, it may be appreciated that there is a continuing need for a new and improved adjustable hinge that addresses the problems of effectiveness and simplicity of construction, and in this respect the present invention substantially fulfills this need.

SUMMARY OF THE INVENTION

In view of the foregoing disadvantages inherent in the known types of adjustable hinges now present in the prior art, the present invention provides an adjustable hinge wherein the same is of a compact organization that may be easily and efficiently secured to relatively movable surfaces for horizontal alignment and accommodation of the surfaces in use. As such, the general purpose of the present invention, which will be described subsequently in greater detail, is to provide a new and improved adjustable hinge which has all the advantages of the prior art adjustable hinges and none of the disadvantages.

To attain this, the present invention comprises an adjustable hinge with a first portion pivotally mounted to a second portion wherein the second portion is formed with an overfolded first and second member wherein a captured threaded screw in a first member adjustably positions the second member relative thereto with a captured spring between the first and second members to eliminate slack between the captured threaded screw and the threaded bore of the second member.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable hinge which has all the advantages of the prior art adjustable hinges and none of the disadvantages.

It is another object of the present invention to provide a new and improved adjustable hinge which may be easily and efficiently manufactured and marketed.

It is a further object of the present invention to provide a new and improved adjustable hinge which is of a durable and reliable construction.

An even further object of the present invention is to provide a new and improved adjustable hinge which is susceptible of a low cost of manufacture with regard to both materials and labor, and which accordingly is then susceptible of low prices of sale to the consuming public, thereby making such adjustable hinges economically available to the buying public.

Still yet another object of the present invention is to provide a new and improved adjustable hinge which provides in the apparatuses and methods of the prior art some of the advantages thereof, while simultaneously overcoming some of the disadvantages normally associated therewith.

Still another object of the present invention is to provide a new and improved adjustable hinge wherein the same provides vertical adjustment of one hinge portion relative to the second hinge portion which a captured spring to eliminate slack between companion threaded portions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
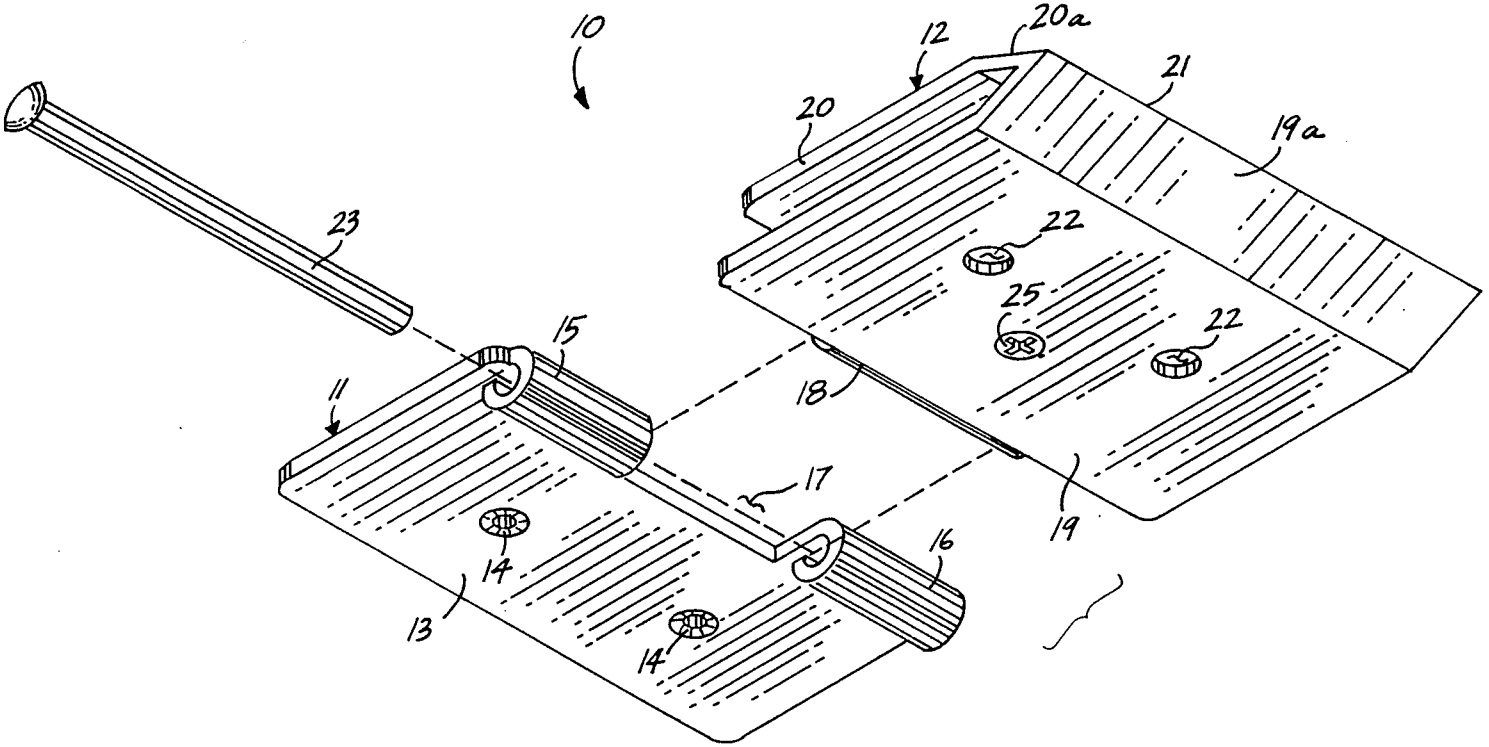
FIG. 1 is an isometric illustration of the instant invention.
Figure 2:
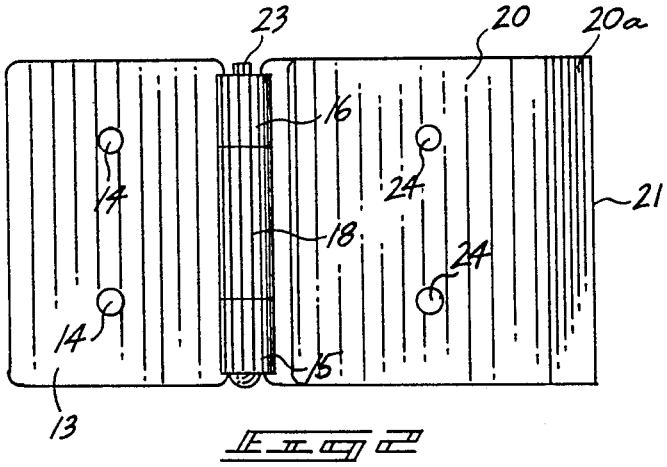
FIG. 2 is a top orthographic view of the instant invention.
Figure 3:
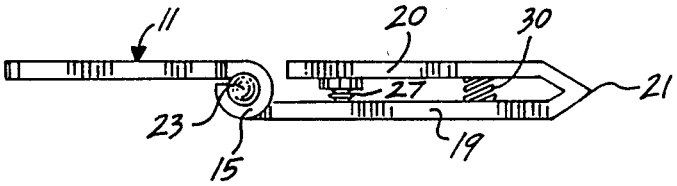
FIG. 3 is an orthographic side view taken in elevation of the instant invention.
Figure 4:
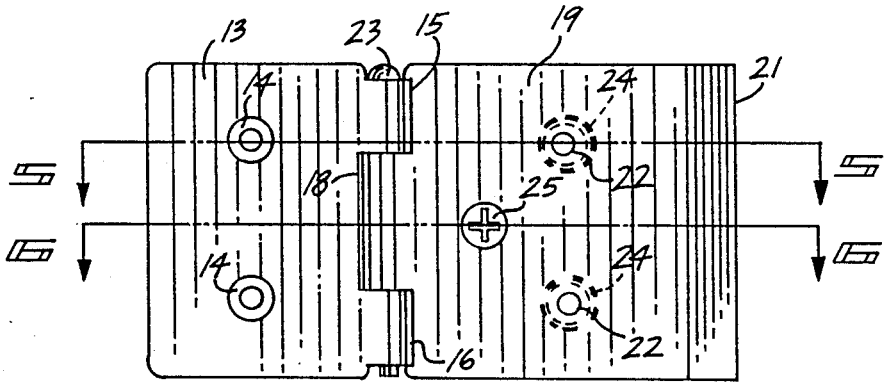
FIG. 4 is a bottom orthographic view of the instant invention.

With reference now to the drawings, and in particular to FIGS. 1 to 8 thereof, a new and improved adjustable hinge embodying the principles and concepts of the present invention and generally designated by the reference numeral 10 will be described.

More specifically, it will be noted that the adjustable hinge 10 essentially comprises a first planar portion 11 pivotally mounted to a second overfolded portion 12. The first planar portion 11 comprises a generally planar plate member 13 formed with a pair of aligned first chamfered openings 14 aligned in a line generally parallel to the axis of rotation between the first and second portions 11 and 12 respectively.

The first planar portion includes a pair of sleeves comprising a first space sleeve 15 to a second space sleeve 16 adjacent terminal sides of the plate member 13 creating a central recess 17 for accepting a third sleeve 18 integrally formed to a lower planar member 19 of the second overfolded portion 12.

The lower planar member 19 has formed thereto a lower bevel surface 19a adjoining an upper bevel surface 20a along a joinder line 21 parallel to the axis of axle 23 pivotally joining the first and second portions together. The joinder of the lower planar member 19 and of overfolded upper planar member 20 is of a somewhat flexible characteristic to enable adjustment of the aforenoted upper planar member 20 to the lower planar member 19 by an adjustment screw 25, to be described in more detail below.

Figure 5:
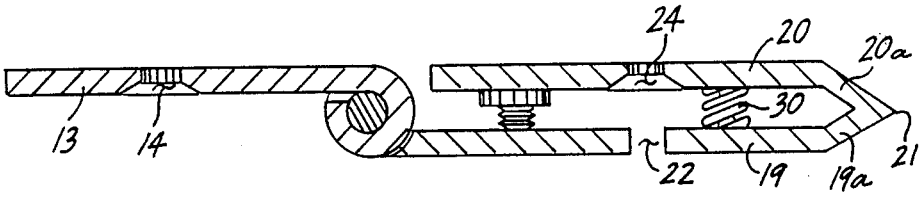
FIG. 5 is an orthographic view taken along the lines 5—5 of FIG. 4.
Figure 6:
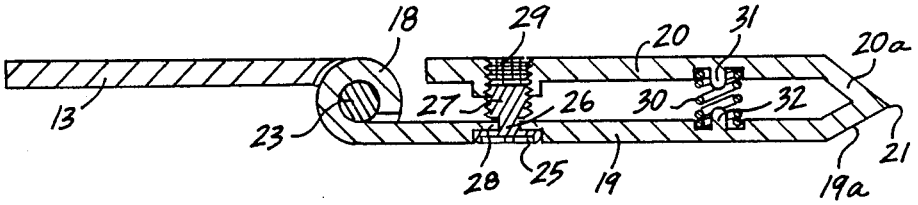
FIG. 6 is an orthographic view taken along the lines 6—6 of FIG. 4.
Figure 7:
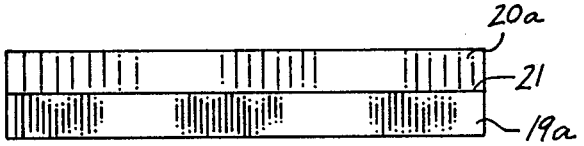
FIG. 7 is an end view taken along the first end of the invention taken in elevation.
Figure 8:
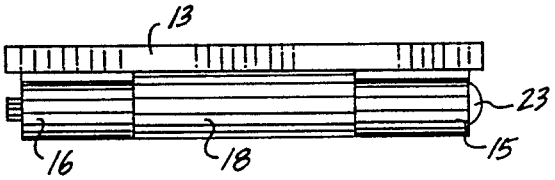
FIG. 8 is a second end view taken in elevation of the instant invention.

Lower planar member 19 has formed a plurality of aligned openings 22 along a line generally parallel to the axis of rotation between the first and second portions overlying and aligned with second chamfered openings formed in an interior surface of upper planar member 20, as illustrated in FIG. 5, enabling access of a rotational torquing member, such as a screw driver, through access openings 22 to enable securement of the upper planar member 20 by means of conventional screws and the like positioned within the second chamber openings 24.

Adjustment screw 25 is captured within the lower planar member 19 by means of a reduced shank 26 formed within the shank of the adjustment screw 25 between the screw 25's head and the diameter threaded shank 27. The reduced shank 26 is accordingly captured within an encircling flange 28 formed within interior surface of the lower planar member 19. A threaded bore 29 is formed in alignment with the axis of adjustment screw 25 through the upper planar member 20 to enable adjustment of the upper planar member 20 relative to the lower planar member 19 by means of rotation of the adjustment screw 25. Furthermore, a coil spring 30 is captured between the upper and lower planar members 19 and 20 respectively and secured by means an upper nipple 31 and a lower nipple 32 integrally formed within recessed sockets of the upper and lower planar members 20 and 19 respectively. The coil spring 30 insures elimination of slack upon adjustment of upper planar member 20 relative to lower planar member 19 to accordingly insure maintaining of alignment. of a surface secured to the upper planar member 20 and thereby enable an adjustment effected by rotation of adjustment screw 25 to be maintained.

Accordingly, the manner of usage and operation of the present invention should be apparent from the above description and therefore no further discussion relative to the manner of usage and operations will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed as being new and desired to be protected by Letters Patent of the United States is as follows:

1. A hinge for adjustment of surfaces secured to relative portions of said hinge, said hinge comprising, a first planar portion pivotally secured to a second overfolded portion;

said second overfolded portion including a lower planar member adjustably secured to an overlying upper planar member, and rotative adjustment means secured to said lower planar member for relative adjustment of said upper planar member relative to said lower planar member, and wherein said first planar portion is pivotally secured to second overfolded portion by an axle captured within a plurality of spaced sleeves, said spaced sleeves secured to opposite ends of said first planar portion providing a recess therebetween for accommodation of a third sleeve integrally secured to said lower planar portion, and wherein said rotative adjustment means includes a threaded screw with a shank threadedly accepted within a threaded bore of said upper planar portion, and wherein said rotative adjustment means further includes a reduced shank between an enlarged head and the shank wherein said reduced shank is captured within an encircling flange integrally formed to an interior surface of said lower planar member, and wherein a coil spring is captured between said lower planar member and said upper planar member, and wherein said coil spring is secured within opposed and aligned sockets formed within opposed interior surfaces of said upper and lower planar members respectively, and said sockets include a centrally formed nipple to maintain alignment of said coil spring between said upper and lower planar members, and wherein said upper planar member includes a plurality of aligned chamfered openings wherein chamfered portions of said chamfered openings are formed within interior surfaces of said upper planar member directed to a through-extending aperture opening to an exterior surface of said upper planar member with aligned aperture formed in said lower planar member in alignment with said aligned chamfered openings for providing access to said aligned chamfered openings.

* * * * *